US006244284B1

(12) United States Patent
Wang

(10) Patent No.: US 6,244,284 B1
(45) Date of Patent: Jun. 12, 2001

(54) FOLDABLE UMBRELLA

(76) Inventor: Max Wang, No. 19, Ta-Yuan-Shih-San St., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/491,074

(22) Filed: Jan. 25, 2000

(51) Int. Cl.[7] ..... A35B 19/10
(52) U.S. Cl. ..... 135/31; 135/25.3; 135/29; 135/23
(58) Field of Search ..... 135/22, 23, 24, 135/25.1, 25.3, 25.31, 26, 29, 31, 32

(56) References Cited

U.S. PATENT DOCUMENTS

| | | | | |
|---|---|---|---|---|
| 2,334,330 | * | 11/1943 | Schultes et al. | 135/26 X |
| 4,077,421 | * | 3/1978 | Schultes et al. | 135/27 X |
| 4,815,489 | * | 3/1989 | Yang | 135/25.3 |
| 5,392,799 | * | 2/1995 | Lai | 135/25.3 |
| 5,494,065 | * | 2/1996 | Kuo et al. | 135/31 |
| 5,553,634 | * | 9/1996 | Yang | 135/25.3 |
| 5,787,912 | * | 7/1998 | Wu | 135/29 |
| 6,035,873 | * | 3/2000 | Lin et al. | 135/25.1 |
| 6,095,170 | * | 8/2000 | Wang | 135/31 |

* cited by examiner

*Primary Examiner*—Carl D. Friedman
*Assistant Examiner*—Winnie Yip
(74) *Attorney, Agent, or Firm*—Ladas & Parry

(57) ABSTRACT

A foldable umbrella includes an elongate handle, a ferrule fixed on an upper end thereof, a runner sleeved slidably on the handle. Each of a plurality of rib assemblies includes elongated first, second and third ribs. The first rib has a first proximate end connected pivotally to the ferrule, a first distal end, a first pivot and a longitudinal slide slot. The second rib has second proximate and second distal ends, and a second pivot disposed adjacent to the second proximate end. The second pivot is connected pivotally to the first distal end of the first rib. The third rib has third proximate and third distal ends, and a third pivot connected pivotally to the second distal end of the second rib. A stretcher has a fourth proximate end connected pivotally to the runner, and a fourth distal end connected pivotally to the first pivot of the first rib. A first connecting member has a proximate end connected pivotally to the stretcher, a distal end connected pivotally to the second proximate end of the second rib, and a transverse projection extending through the slide slot of the first rib to connect pivotally with one end of a second connecting member.

4 Claims, 6 Drawing Sheets

FOLDABLE UMBRELLA

FIELD OF THE INVENTION

The invention relates to an umbrella, more particularly to a foldable umbrella which has a plurality of three-fold rib assemblies and a plurality of connecting members that are made of a rigid material for strengthening the rib assemblies when the umbrella is in use.

BACKGROUND OF THE INVENTION

Referring to FIG. 1, a conventional foldable umbrella 10 is shown to include an elongate handle 18, a ferrule 17, a runner 19, a plurality of rib assemblies, and a plurality of stretcher assemblies.

As illustrated, the handle 18 has an upper end 180, a lower end 181 and a middle portion 182 between the upper and lower ends 180,181. The ferrule 17 is fixed on the upper end 180 of the handle 18. The runner 19 is sleeved slidably on the middle portion 182 of the handle 18. Each of the rib assemblies includes a first rib 11, a second rib 12, and a third rib 13. The first rib 11 has a first proximate end 110 connected pivotally to the ferrule 17, a first distal end 111 opposite to the first proximate end 110, and a first pivot 112 between the first proximate and first distal ends 110,111. The second rib 12 has second proximate and second distal ends 121,122 opposite to each other relative to the ferrule 17, and a second pivot 123 between the second proximate and second distal ends 121,122 and disposed adjacent to the second proximate end 121. The second pivot 123 is connected pivotally to the first distal end 111 of the first rib 11.

Each of the stretcher assemblies includes a stretcher 14, a first connecting member 15 and a second connecting member 16. The stretcher 14 has a third proximate end 141 connected pivotally to the runner 19, and a third distal end 142 connected pivotally to the first pivot 112 of the first rib 11 of a corresponding one of the rib assemblies. The first connecting member 15 is a non-flexible elongate member having a fourth proximate end 150 connected pivotally to the stretcher 14 adjacent to the third distal end 142, and a fourth distal end 151 connected pivotally to the second proximate end 121 of the second rib 12 of the corresponding one of the rib assemblies. The third rib 13 has fifth proximate and fifth distal ends 131,132 opposite to each other relative to the ferrule 17, and a third pivot 133 between the fifth proximate and fifth distal ends 131, 132 and disposed adjacent to the fifth proximate end 131. The third pivot 133 is connected pivotally to the second distal end 122 of the second rib 12. The second connecting member 16 is a flexible elongate member and has a sixth proximate end 161 connected pivotally to the first rib 11 adjacent to the first distal end 111, and a sixth distal end 162 connected pivotally to the fifth proximate end 131 of the third rib 13 of the corresponding one of the rib assemblies. Movement of the runner 19 along the handle 18 will cause the first, second and third ribs 11,12, 13 of the rib assemblies to move between spread-out and collapsed positions. The second connecting member 16 supports the third rib 13 of the corresponding one of the rib assemblies in the spread-out state.

However, a drawback of the aforesaid conventional foldable umbrella arises in the presence of relatively strong wind. It is noted that the second connecting members 16 are flexible members which can lead to ease of deformation of the rib assemblies.

In U.S. patent Ser. No. 09/407,153 by the applicant, there is disclosed a foldable umbrella that includes an elongate handle, a ferrule fixed on an upper end of the handle, and a runner sleeved slidably on a middle portion of the handle. Each of a plurality of rib assemblies includes a first rib having an elongate abutment wall with opposite longitudinal edges, two opposite side walls that extend downwardly and respectively from the longitudinal edges of the abutment wall, a first proximate end connected pivotally to the ferrule, a first distal end opposite to the first proximate end, and a first pivot between the first proximate and first distal ends. A second rib has second proximate and second distal ends opposite to each other relative to the ferrule, and a second pivot between the second proximate and second distal ends and disposed adjacent to the second proximate end. The second pivot is connected pivotally to the first distal end of the first rib. Each of a plurality of stretcher assemblies includes a stretcher having a third proximate end connected pivotally to the runner, and a third distal end connected pivotally to the first pivot of the first rib of a corresponding one of the rib assemblies. A flexible and elongate connecting member has a fourth proximate end connected pivotally to the stretcher adjacent to the third distal end, a fourth distal end connected pivotally to the second proximate end of the second rib of the corresponding one of the rib assemblies, and an intermediate portion between the fourth proximate and fourth distal ends. The connecting member has a length sufficient to cause the intermediate portion to flex so as to extend between the side walls and abut against the abutment wall of the first rib of the corresponding one of the rib assemblies when the first and second ribs of the corresponding one of the rib assemblies are generally aligned with one another in a spread-out state of the corresponding one of the rib assemblies.

The intermediate portion of the connecting member is straightened when an external force applied on the second rib of the corresponding one of the rib assemblies causes the second rib of the corresponding one of the rib assemblies to pivot upwardly relative to the first rib about the second pivot in the spread-out state of the corresponding one of the rib assemblies to avoid deformation of the second rib.

SUMMARY OF THE INVENTION

The main object of this invention is to provide a foldable umbrella which is clear of the aforesaid drawback that generally results from the use of the conventional foldable umbrella.

Accordingly, a foldable umbrella of the present invention includes an elongate handle having an upper end, a lower end and a middle portion between the upper and lower ends. A ferrule is fixed on the upper end of the handle. A runner is sleeved slidably on the middle portion of the handle, and is movable between a lower position with respect to the ferrule, where the umbrella is in a folded state, and an upper position, where the umbrella is in a spread-out state. Each of a plurality of rib assemblies includes elongated first, second and third ribs. The first rib has a first proximate end connected pivotally to the ferrule, a first distal end opposite to the first proximate end, a first pivot between the first proximate and distal ends, and a longitudinal slide slot formed therethrough between the first pivot and the first distal end. The second rib has second proximate and second distal ends opposite to each other relative to the ferrule, and a second pivot between the second proximate and second distal ends and disposed adjacent to the second proximate end. The second pivot is connected pivotally to the first distal end of the first rib. The third rib has third proximate and third distal ends opposite to each other relative to the ferrule, and a third pivot between the third proximate and third distal ends and disposed adjacent to the third proximate end. The third pivot is connected pivotally to the second distal end of the second rib. Each of a plurality of stretcher assemblies includes a stretcher, an elongate non-flexible first connecting member, and an elongate rigid second connecting member. The stretcher has a fourth proximate end connected pivotally to the runner, and a fourth distal end connected pivotally to the first pivot of the first rib of a corresponding one of the rib assemblies. The first connecting member has a fifth proximate end connected pivotally to the stretcher adjacent to the fourth distal end, a fifth distal end connected pivotally to the second proximate end of the second rib of the corresponding one of the rib assemblies, and a transverse projection formed adjacent to the fifth distal end and extending slidably through the slide slot in the first rib. The rigid second connecting member has a sixth proximate end connected pivotally to the transverse projection of the first connecting member, and a sixth distal end connected pivotally to the third proximate end of the third rib of the corresponding one of the rib assemblies. The slide slot in the first rib has a length sufficient to cause the first, second and third ribs of the corresponding one of the rib assemblies to generally align with one another when the umbrella is in the spread-out state. The runner is biased to the lower position so as to collapse the rib assemblies. The second connecting members have a rigidity and dimensions that are sufficient to prevent the deformation of the rib assemblies.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
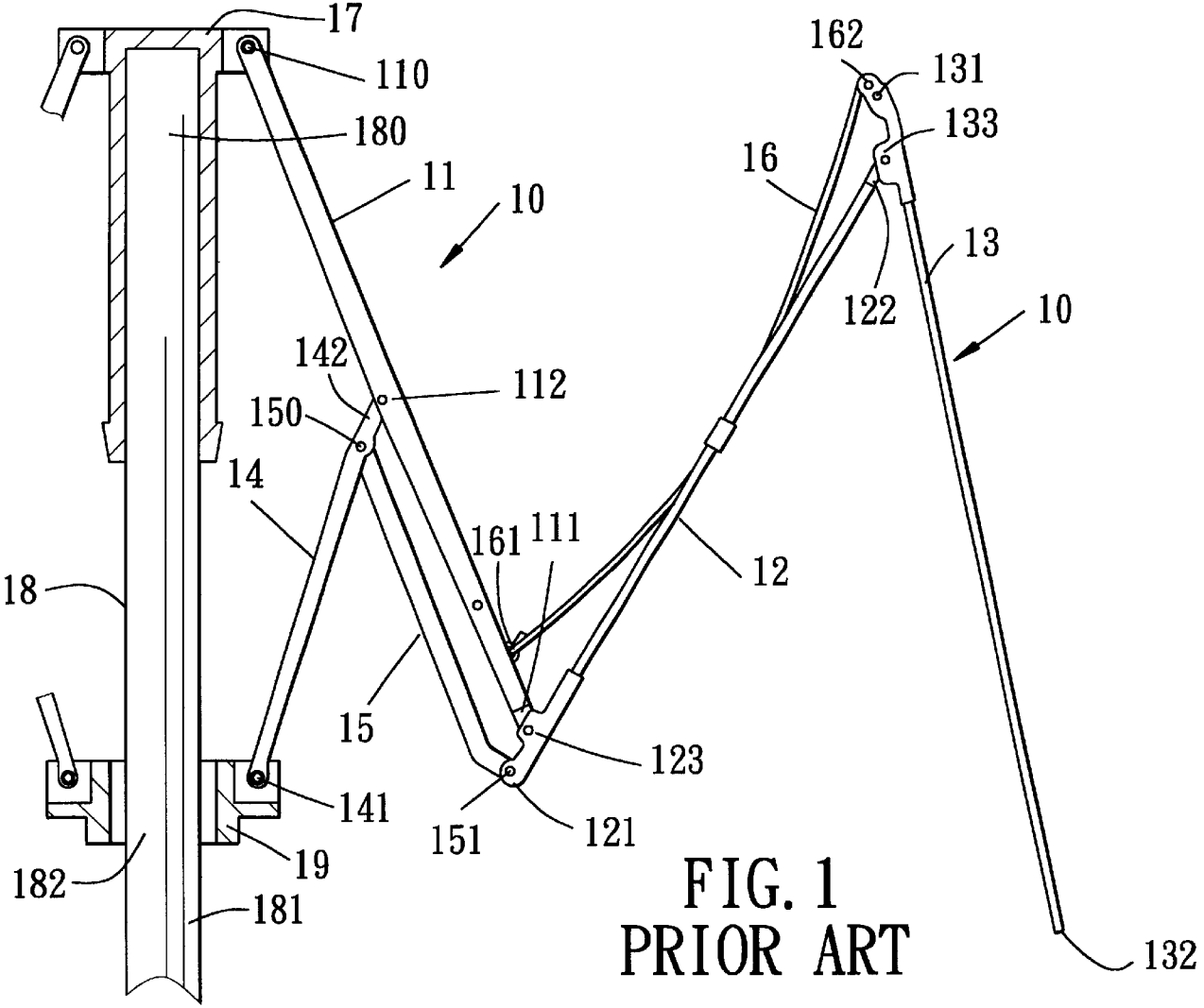
FIG. 1 PRIOR ART
FIG. 1 illustrates a portion of a conventional foldable umbrella in a folded state.
Figure 2:
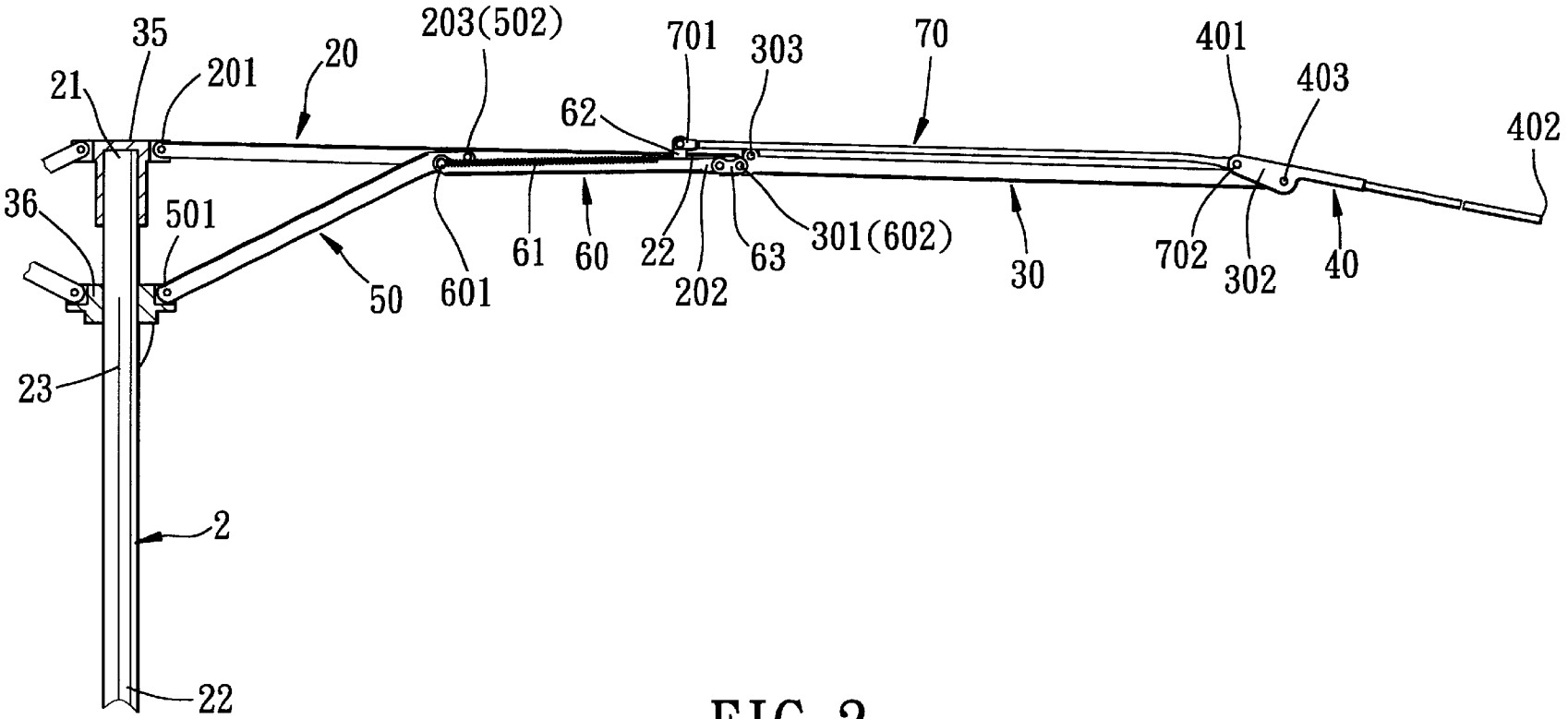
FIG. 2 illustrates a portion of a preferred embodiment of a foldable umbrella of the present invention in a spread-out state.
Figure 3:
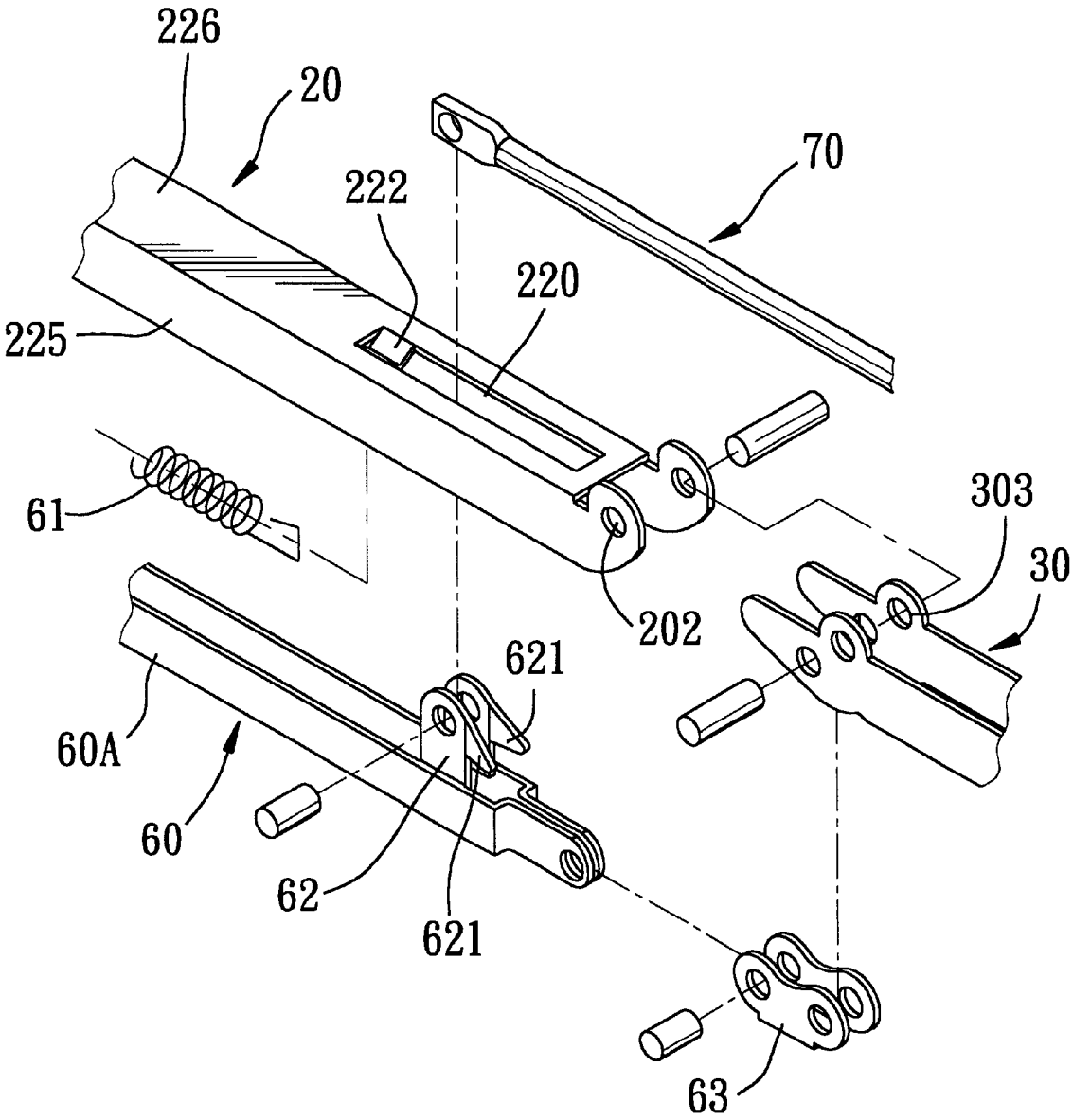
FIG. 3 is an exploded of a portion of a rib assembly of the preferred embodiment.
Figure 4:
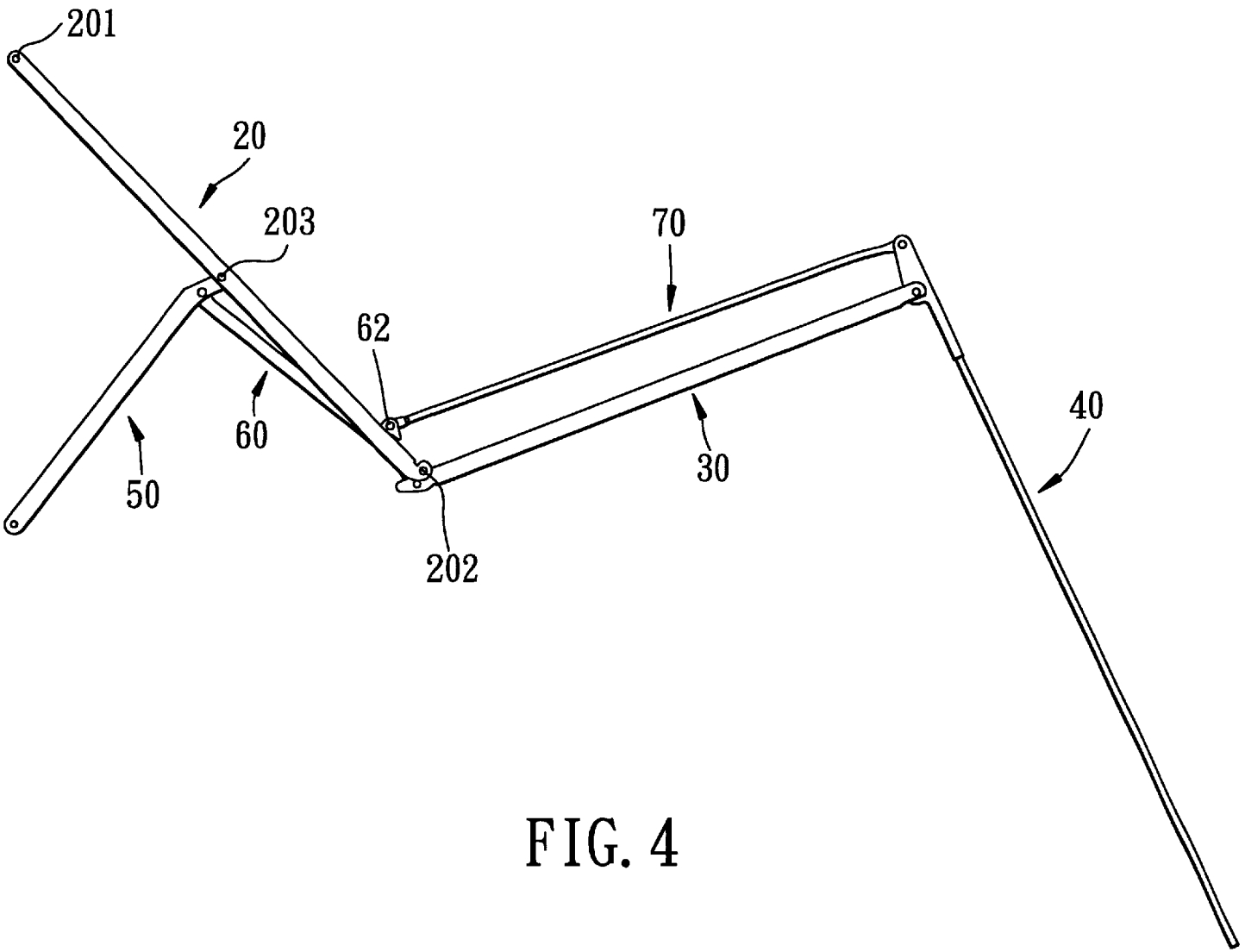
FIG. 4 illustrates how first and second connecting members are interconnected in the preferred embodiment.
Figure 5:
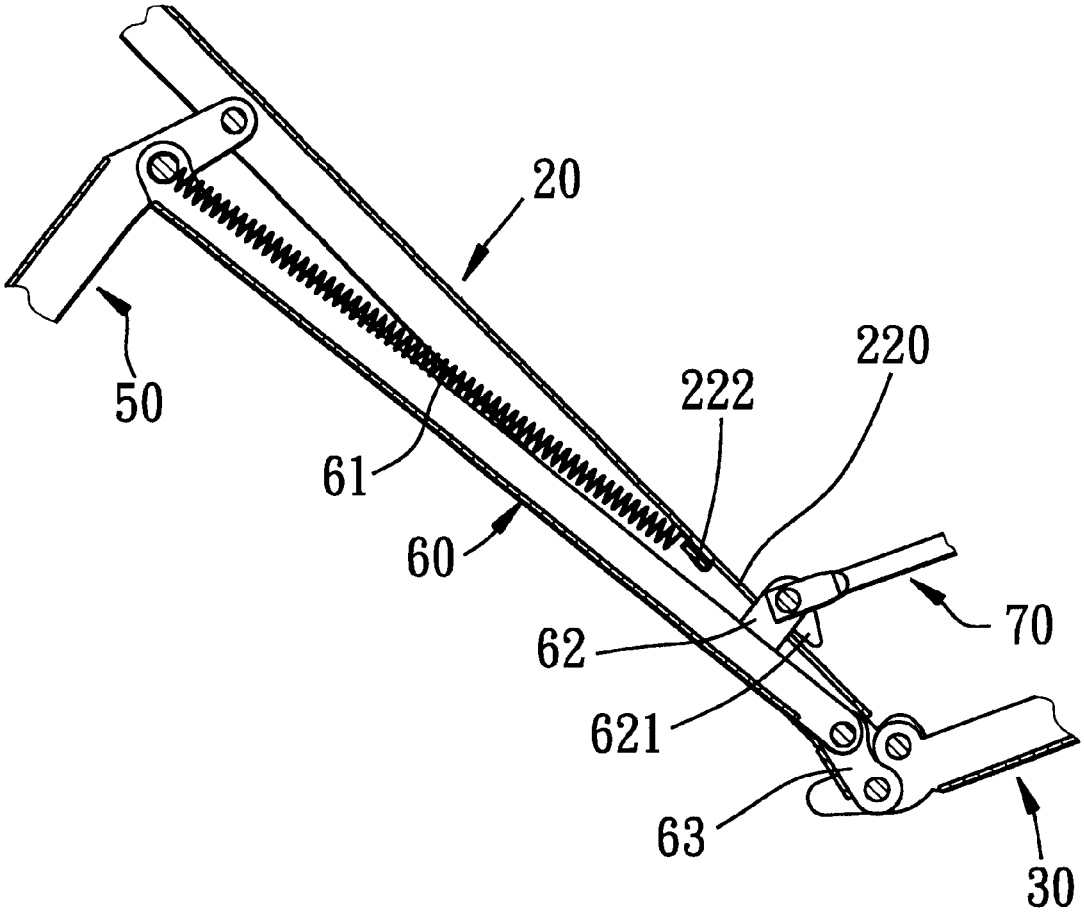
FIG. 5 illustrates how a biasing means is employed in the preferred embodiment in order to bias the rib assemblies to a folded state.

Referring to FIGS. 2, 3 and 4, the preferred embodiment of a foldable umbrella of the present invention is shown to include an elongate handle 2, a ferrule 35 fixed on an upper end 21 of the handle 2, a runner 36 sleeved slidably on a middle portion 23 of the handle 2, a plurality of rib assemblies (only one is shown), and a plurality of stretcher assemblies (only one is shown).

Figure 6:
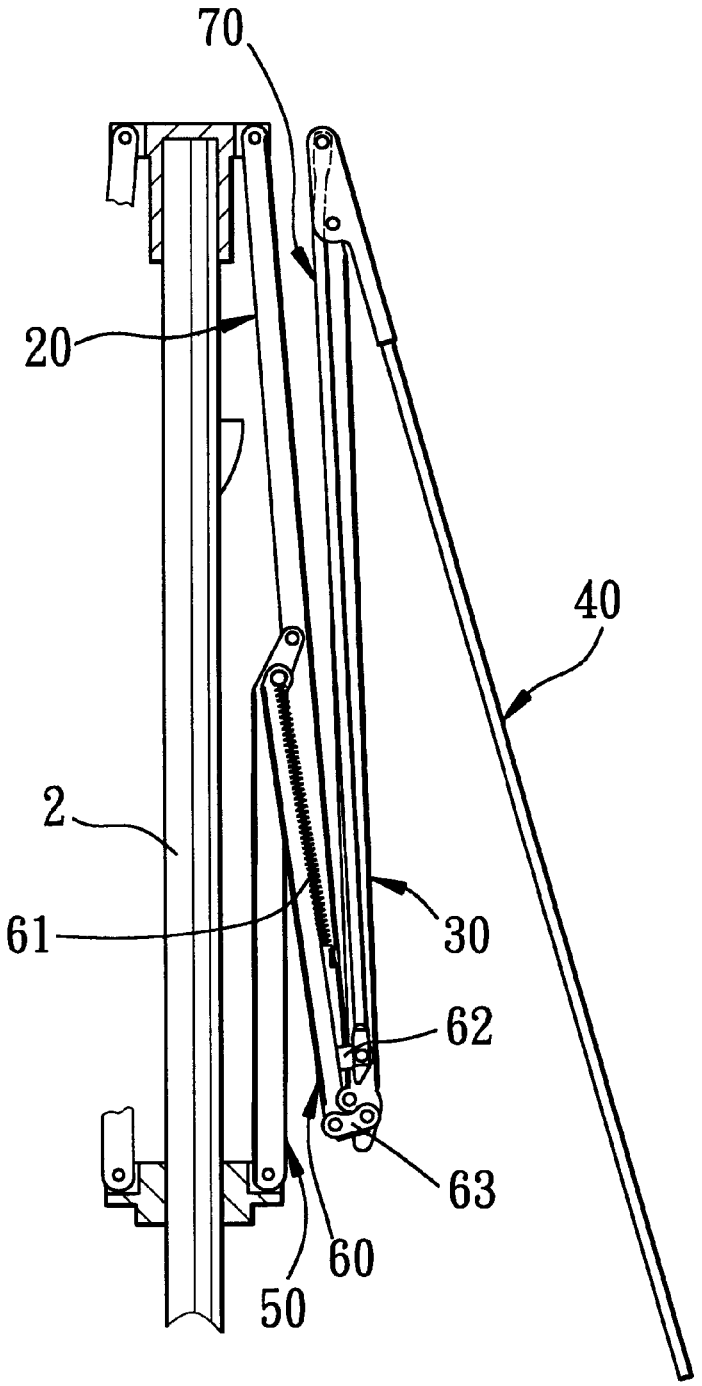
FIG. 6 shows the rib assemblies of the preferred embodiment in the folded state.

As illustrated, the runner 36 is movable on the middle portion 23 of the handle 2 between a lower position with respect to the ferrule 35, where the umbrella is in a folded state, as best shown in FIG. 6, and an upper position, where the umbrella is in a spread-out state, as best shown in FIG. 2.

Each of the rib assemblies includes a first rib 20, a second rib 30, and a third rib 40. The first rib 20 has a first proximate end 201 connected pivotally to the ferrule 35, a first distal end 202 opposite to the first proximate end 201, a first pivot 203 between the first proximate and distal ends 201,202, and a longitudinal slide slot 220 (see FIG. 3) formed therethrough between the first pivot 203 and the first distal end 202. The second rib 30 has second proximate and second distal ends 301,302 opposite to each other relative to the ferrule 35, and a second pivot 303 between the second proximate and second distal ends 301,302 and disposed adjacent to the second proximate end 301. The second pivot 303 is connected pivotally to the first distal end 202 of the first rib 20. The third rib 40 has third proximate and third distal ends 401,402 opposite to each other relative to the ferrule 35, and a third pivot 403 between the third proximate and third distal ends 401,402 and disposed adjacent to the third proximate end 401. The third pivot 403 is connected pivotally to the second distal end 302 of the second rib 30.

Each of the stretcher assemblies includes a stretcher 50, an elongate non-flexible first connecting member 60, and an elongate rigid second connecting member 70. The stretcher 50 has a fourth proximate end 501 connected pivotally to the runner 36, and a fourth distal end 502 connected pivotally to the first pivot 203 of the first rib 20 of a corresponding one of the rib assemblies. The first connecting member 60 has a fifth proximate end 601 connected pivotally to the stretcher 50 adjacent to the fourth distal end 502, a fifth distal end 602 connected pivotally to the second proximate end 301 of the second rib 30 of the corresponding one of the rib assemblies, and a transverse projection 62 formed adjacent to the fifth distal end 602. The transverse projection 62 extends slidably through the slide slot 220 in the first rib 20. The rigid second connecting member 70 has a sixth proximate end 701 connected pivotally to the transverse projection 62 of the first connecting member 60, and a sixth distal end 702 connected pivotally to the third proximate end 401 of the third rib 40 of the corresponding one of the rib assemblies. The slide slots 220 in the first ribs respectively have a length sufficient to cause the first, second and third ribs 20,30,40 of the corresponding one of the rib assemblies to generally align with one another when the umbrella is in the spread-out state (see FIG. 2).

A plurality of tension springs 61 are disposed in the first connecting members 60 respectively such that each of the tension springs 61 has a first end fixed to the stretcher 50 adjacent to the fourth distal end 502 and a second end that extends through the respective slide slot 220 so as to be hooked on an indented portion 222 of the first rib 20 at a position adjacent to an end of the slide slot 220. The tension springs 60 cooperatively pull and collapse the second and third ribs 30, 40 on the first ribs 20 and consequently bias the runner 36 to the lower position.

In the preferred embodiment, the first rib 20 of each of the rib assemblies includes two opposite side walls 225 (see FIG. 3) extending between the first proximate and first distal ends 201,202 thereof and an intermediate wall 226 interposed between the side walls 225. The slide slots 220 are formed through the intermediate walls 226. Each of the first connecting members 60 includes a knuckle piece 63, and a straight rod 60A having an inner end portion that serves as the fourth proximate end 601 and that is connected pivotally to a corresponding one of the stretchers 50, and an outer end portion on which a corresponding one of the transverse projections 62 is formed. The knuckle piece 63 is connected pivotally to the outer end portion of the straight member 60A at one end thereof and to the second proximate end 301 of a corresponding one of the second ribs 30 at the other end so as to overlap the second rib 30 on the first rib 20.

In the preferred embodiment, each of the transverse projections 62 is formed by two-spaced pieces which are formed respectively with two tapered ends 621 bent outwardly away from each other to define a distance therebetween that is greater than the width of the slide slot 220 so as to prevent disengagement of the transverse projection 62 from the slide slot 220.

With this invention thus explained, it is apparent that numerous modifications and variations can be made without departing from the scope and spirit of this invention. It is therefore intended that this invention be limited only as indicated in the appended claims.

I claim:

1. A foldable umbrella, comprising:

an elongate handle having an upper end, a lower end and a middle portion between said upper and lower ends ;

a ferrule fixed on said upper end of said handle ;

a runner sleeved slidably on said middle portion of said handle and movable between a lower position with respect to said ferrule, where said umbrella is in a folded state, and an upper position, where said umbrella is in a spread-out state;

a plurality of rib assemblies, each including an elongated first rib having a first proximate end connected pivotally to said ferrule, a first distal end opposite to said first proximate end, a first pivot between said first proximate and distal ends, and a longitudinal slide slot formed therethrough between said first pivot and said first distal end, a second rib having second proximate and second distal ends opposite to each other relative to said ferrule, and a second pivot between said second proximate and second distal ends and disposed adjacent to said second proximate end, said second pivot being connected pivotally to said first distal end of said first rib, a third rib having third proximate and third distal ends opposite to each other relative to said ferrule, and a third pivot between said third proximate and third distal ends and disposed adjacent to said third proximate end, said third pivot being connected pivotally to said second distal end of said second rib, and a plurality of stretcher assemblies, each including a stretcher having a fourth proximate end connected pivotally to said runner, and a fourth distal end connected pivotally to said first pivot of said first rib of a corresponding one of said rib assemblies, an elongate non-flexible first connecting member having a fifth proximate end connected pivotally to said stretcher adjacent to said fourth distal end, a fifth distal end connected pivotally to said second proximate end of said second rib of the corresponding one of said rib assemblies, and a transverse projection formed adjacent to said fifth distal end and extending slidably through said slide slot in said first rib, and an elongate rigid second connecting member having a sixth proximate end connected pivotally to said transverse projection of said first connecting member, and a sixth distal end connected pivotally to said third proximate end of said third rib of the corresponding one of said rib assemblies, said slide slot in said first rib having a length sufficient to cause said first, second and third ribs of the corresponding one of said rib assemblies to generally align with one another when said umbrella in the spread-out state; and means for biasing said runner to said lower position so as to collapse said rib assemblies.

2. The foldable umbrella as defined in claim 1, wherein said first rib of each of said rib assemblies further includes two opposite side walls extending between said first proximate and first distal ends thereof and an intermediate wall interposed between said side walls, said slide slots being formed through said intermediate walls of said first ribs.

3. The foldable umbrella as defined in claim 1, wherein each of said first connecting members includes a straight rod having an inner end portion serving as said fourth proximate end and connected pivotally to a corresponding one of said stretchers, and an outer end portion on which a corresponding one of said transverse projections is formed, and a knuckle piece connected pivotally to said outer end portion of said straight rod at one end thereof and to said second proximate end of a corresponding one of said second ribs at the other end and serving as said fourth distal end.

4. The foldable umbrella as defined in claim 3, wherein each of said transverse projections is formed by two-spaced pieces which are formed with two tapered ends bent outwardly away from each other to define a distance therebetween that is greater than a width of said slide slot so as to prevent disengagement of the transverse projection from said slide slot.

* * * * *